US005465548A

United States Patent [19]

Niese

[11] Patent Number: 5,465,548

[45] Date of Patent: Nov. 14, 1995

[54] PREFABRICATED SLEEPER FOR ANCHORED AND RESILIENT HARDWOOD FLOOR SYSTEM

[75] Inventor: Michael W. Niese, Cincinnati, Ohio

[73] Assignee: Robbins, Inc., Cincinnati, Ohio

[21] Appl. No.: 366,685

[22] Filed: Dec. 30, 1994

Related U.S. Application Data

[62] Division of Ser. No. 213,947, Mar. 16, 1994, Pat. No. 5,377,471.

[51] Int. Cl.[6] ..... E04B 1/00

[52] U.S. Cl. ..... 52/741.1; 29/897.3

[58] Field of Search ..... 52/741.1, 745.19, 52/745.08, 745.13; 29/897.3, 897.33, 897.35

[56] References Cited

U.S. PATENT DOCUMENTS

| | | | |
|---|---|---|---|
| 4,856,250 | 8/1989 | Gronau | 52/480 |
| 4,890,434 | 1/1990 | Niese | 52/480 X |
| 5,303,526 | 4/1994 | Niese | 52/480 X |
| 5,369,927 | 12/1994 | Counihan | 52/480 X |
| 5,377,471 | 1/1995 | Niese | 52/482 |
| 5,388,380 | 2/1995 | Niese | 52/480 |

*Primary Examiner*—Carl D. Friedman
*Assistant Examiner*—Creighton Smith
*Attorney, Agent, or Firm*—Wood, Herron & Evans

[57] ABSTRACT

A prefabricated sleeper reduces labor costs associated with installing an anchored, resilient hardwood floor system. The prefabricated sleeper includes an elongated channel, pads located along the channel and an elongated nailing strip supported on the pads within the channel. A plurality of vertical access holes extend through the nailing strip. The pads are removed laterally from the access holes. The access holes enable a fastening gun to be inserted therein and into direct contact with the bottom of the channel to facilitate driving of fasteners through the bottom of the channel and directly into a base below. This prefabricated sleeper is formed by milling an elongated wooden strip to a desired T-shape and then drilling access holes therethrough. Pads are then stapled to the enlarged end of the T-shape, away from the access holes. An elongated sheet of steel is then rolled around the pads and the sides of the nailing strip to form a C-shaped channel thereabout.

8 Claims, 3 Drawing Sheets

PREFABRICATED SLEEPER FOR ANCHORED AND RESILIENT HARDWOOD FLOOR SYSTEM

This application is a divisional application of applicant's prior U.S. application Ser. No. 08/213,947, filed Mar. 16, 1994 now U.S. Pat. No. 5,377,471.

FIELD OF THE INVENTION

This invention relates to hardwood floor systems. More particularly, this invention relates to a prefabricated sleeper which reduces the cost of installing an anchored and resilient hardwood floor system.

BACKGROUND OF THE INVENTION

Hardwood floor systems provide numerous advantages over other types of floors. Due to surface uniformity, aesthetics and injury reduction which results from a high degree of resiliency, many athletes and exercisers prefer hardwood floor systems over floors made of other materials.

One well-recognized disadvantage of hardwood floor systems relates to moisture. The maple floorboards commonly used in hardwood floor systems expand and contract from moisture absorption and drying out, respectively, due to the varying levels of humidity in the air during the four seasons of the year. In many cases, the horizontal expansion and contraction forces may eventually cause the floorboards to vertically raise up at locations of least resistance. Sometimes this vertical raising can be detected visually. Other times, it becomes noticeable only as a "dead spot" in the floor during athletic activities. Regardless, the performance of the floor may become seriously impaired as a direct result of horizontal expansion and contraction caused by moisture content.

Sleeper-type floor systems reduce the adverse effects of moisture. In a sleeper-type floor system, the floorboards are held in spaced relation above a base by parallel supports which are referred to as "sleepers". This spacing enables air to circulate between the base and the floorboards, thereby eliminating direct transfer of moisture therebetween. Anchoring of the sleepers to the base further minimizes the adverse effects of expansion and contraction due to moisture.

As with all hardwood floor systems, it is desirable to construct sleeper-type floor systems which also have a sufficiently high degree of resiliency. The resiliency of a floor system may be quantified by measuring a number of performance characteristics, including shock absorption, deflectability and deflectability containment. The resilience of a floor system plays an important role in minimizing impact-related injuries.

U.S. Pat. No. 4,856,250, entitled "Sleeper For The Attachment of Covering Material To A Surface", discloses a sleeper-type hardwood floor system with anchored and resilient characteristics. The floor system disclosed in this patent achieves a relatively high degree of resilience by providing an inverted, T-shaped nailing strip supported on a foam strip within a guideway. An upper portion of the strip protrudes above the top of the channel, and a lower, wider portion of the strip resides below opposing tabs of the guideway. Fasteners secure the channel to a concrete base. The channel is anchored to the base prior to moving the pad and nailing strip therein. This construction enables the nailing strips to deflect downwardly upon impact, but prevents them from vertically raising, as may occur during expansion or contraction. In short, it is primarily the sleeper construction which provides the anchored and resilient characteristics for the floor system.

Unfortunately, the sleeper disclosed in U.S. Pat. No. 4,856,250 can be relatively difficult and expensive to install, due to separate shipping of the sleeper components to the job site and a multi-step, labor-intensive installation of these components. More particularly, to install the floor system disclosed in U.S. Pat. No. 4,856,250, the guideways must first be mechanically fastened to the base, with every other guideway in each row offset from the next adjacent guideways to permit lateral access therein. Then, a resilient foam strip must be slid horizontally into the channel. Finally, an inverted, T-shaped nailing strip must be slid horizontally within the guideway, between the foam strip and the two opposing tabs. Thus, sleeper installation requires three separate steps. Floorboards are then nailed to the nailing strips.

While the combined vertical dimension of the foam strip and the nailing strip is less than the inside vertical dimension of the guideway beneath the tabs, it can become extremely difficult to horizontally slide the elongated foam strip and the elongated nailing strip along the entire length of the guideway. If the nailing strip is warped at all, the horizontal sliding becomes even more difficult. Because of the manner of inserting the foam strip and the nailing strip, the sleeper length must be kept relatively short.

Also, with this sleeper assembly, the tolerance of the Vertical dimension of the form strip and the nailing strip with respect to the vertical dossimer of the channel must be made fairly high. Otherwise, it would not be possible to slide the components into the channel. However, with this higher tolerance, the actual vertical dimensions of the sleeper components may vary along their lengths. These dimensional variations may cause variations in loading characteristics along the length of the sleeper. As a result, the surface of the floor system will not be uniform in response to an applied load.

Another disadvantage associated with on-site installation of the separate components of this sleeper relates to the consistency and accuracy of securing the guideways. To support the floorboards properly, the bottoms of the guideways must directly contact the base, or leveling shims supported on the base, and the fasteners must be driven into the base at a 90° angle. Otherwise, the guideways may be susceptible to longitudinal or transverse expansion or contraction forces. Moreover, if the heads of the fasteners protrude too far upwardly, the lateral movement of the foam and nailing strip during installation may be impeded. Because these fasteners are usually driven through the bottoms of the guideways by a hand-held gun, there is no guarantee that they will be consistently driven into the base at the preferred 90° angle.

It is an objective of this invention to simplify and reduce costs associated with the shipping and installation of sleepers used to support an anchored and resilient hardwood floor system.

It is another object of the invention to meet tighter tolerances with a sleeper for an anchored and resilient floor system, thereby to enhance the uniformity of the load-response characteristics of the floor.

It is still another object of the invention to accurately and consistently install the sleepers of an anchored and resilient hardwood floor system.

The objectives of this invention are achieved by providing a prefabricated sleeper that may be easily manufactured in a shop and then shipped to the job site in a form which is ready to be installed. The invention contemplates a prefabricated sleeper which includes an elongated channel and a nailing strip supported on a plurality of pads within the channel, wherein the nailing strip has at least one vertical access hole formed therethrough to provide simple and direct access to the bottom of the channel to facilitate securement to a base.

During installation, a fastening gun is inserted within the access hole and into contact with the bottom of the channel. The sizing of the gun and the access hole requires that the gun be oriented at 90° in order to contact the bottom of the channel. In this position, a fastener may be shot out of the gun at a 90° angle, through the bottom of the channel and into the base.

This prefabricated sleeper provides both anchoring and resiliency for a hardwood floor system. At the same time, this prefabricated sleeper significantly reduces the time and cost associated with installing an anchored, resilient hardwood floor system. Moreover, shipping costs for this prefabricated sleeper are minimized, because only one, preassembled sleeper construction must be shipped, rather than multiple components.

According to a preferred embodiment of the invention, this prefabricated sleeper includes an elongated steel channel. The channel has a bottom and two parallel, spaced sides. Upper ends of the sides are turned in to define flanges which enclose the top of the channel and define a "C" shape, in cross section. A plurality of compressible and deflectable pads are located within the channel. An elongated, inverted, T-shaped nailing strip is supported by the pads and is also located within the channel. An upper portion of the nailing strip extends above the partially enclosed top of the channel. An enlarged bottom portion of the nailing strip is defined by two shoulders, each of which is located below one of the flanges of the channel. A plurality of vertical access holes extend vertically through the nailing strip, thereby to provide direct access to the bottom of the channel to facilitate mounting to a base in prefabricated form.

The structural arrangement of these components provides a sleeper with a tighter dimensional tolerance. Thus, the load-response characteristics of this prefabricated sleeper are the same along its entire length. This enhances the overall capability of the floor system for providing uniformity in resilient, load-response characteristics.

To manufacture this prefabricated sleeper, an elongated wood strip is milled to form a T-shape. After milling the strip to a T-shape, a plurality of access holes are drilled through the nailing strip. The access holes extend from an enlarged first end of the T-shape to a reduced second end. A plurality of pads are then mechanically fastened to the enlarged end of the T-shaped strip, with the pads spaced away from the access holes. Preferably, the pads are stapled to the nailing strip. An elongated strip of steel is then located adjacent the pads, rolled around opposite sides of the nailing strip and then turned inwardly beyond the shoulders of the nailing strip. This partially encloses the nailing strip, with the upper portion extending beyond the turned-in edges. In this form, the prefabricated sleeper is ready for shipment to the job site.

At the job site, the prefabricated sleepers are preferably laid end to end in parallel rows. The sleepers should be oriented in a direction which is perpendicular to the final orientation of the floorboards. Preferably, adjacent rows of sleepers are staggered so that the ends of the sleepers are offset. Floorboards may then be secured to the nailing strips via nails driven through the floorboards and into the upper portions of the nailing strips.

In a preferred floor system utilizing this prefabricated sleeper, a layer of panels is located between the floorboards and the sleepers. The panels are secured to the sleepers, and the floorboards are secured to the panels. This layer of panels provides an additional degree of uniformity and stability for the floor system. If desired, additional layers of panels may be used, either with or without floorboards secured to an uppermost layer of the panels.

These and other features of the invention will be more readily understood in view of the following detailed description and the drawings.

DETAILED DESCRIPTION OF THE DRAWINGS

Figure 1:
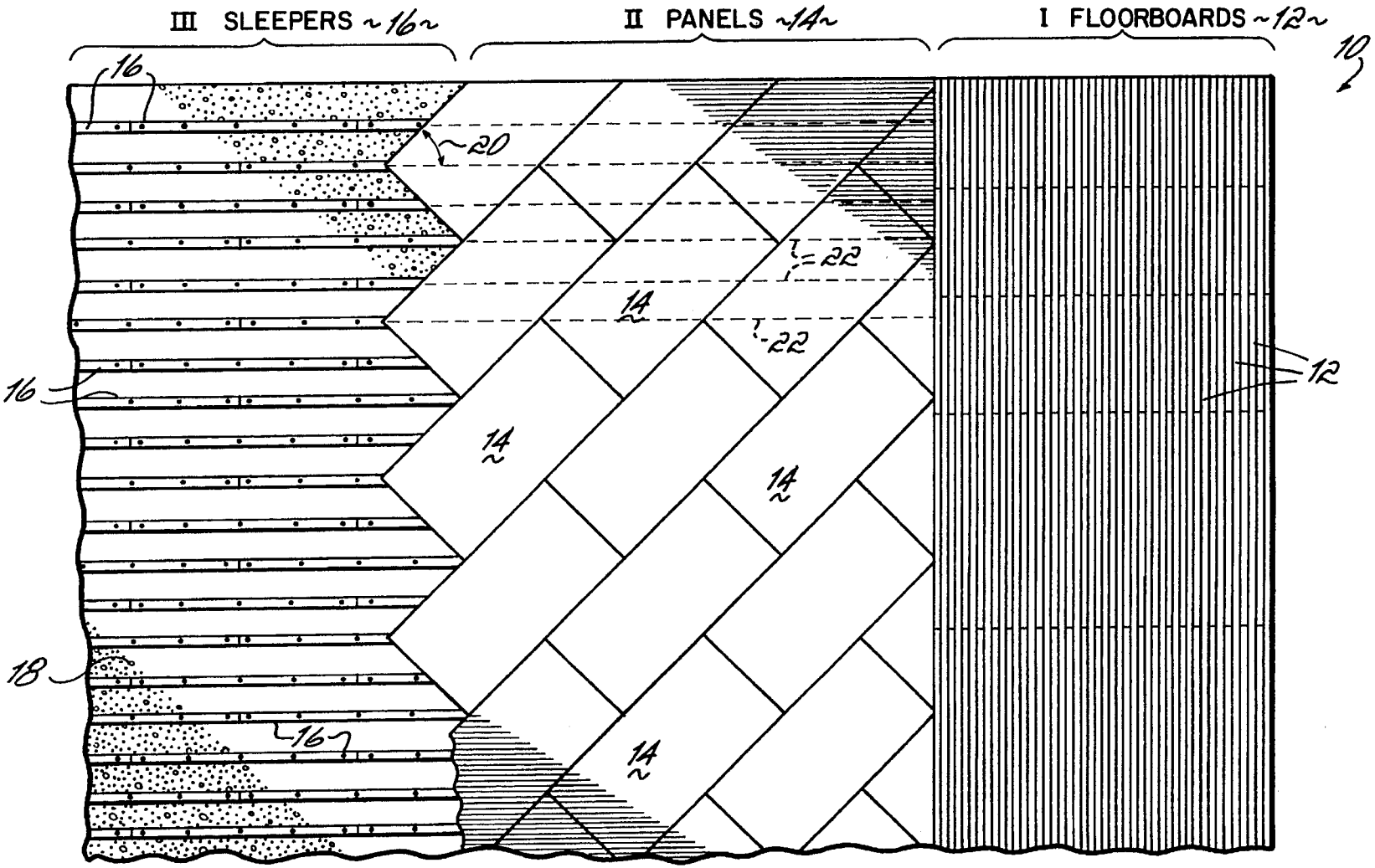
FIG. 1 is a plan view of a hardwood floor system in accordance with a preferred embodiment of the invention.

FIG. 1 is a plan view of a hardwood floor system 10 according to a preferred embodiment of the invention. The floor system 10 includes an upper layer with a wear surface 12 suitable for the desired use of the floor. In many cases, the wear surface 12 comprises floorboards 12 secured to a subfloor of one layer of panels 14. The panels 14 are secured to a plurality of prefabricated sleepers 16, and the sleepers 16 are secured to a base 18 which is usually concrete. The floorboards 12, the panels 14, and the sleepers 16 and the base 18 are shown in sections I, II and III, respectively, of FIG. 1. The floorboards 12 may be tongue-and-groove maple, as is common in the hardwood floor industry. However, other wood or plastic materials would also be suitable, depending upon the use of the floor system 10.

The panels 14 are preferably 4'×8' plywood panels with a thickness of about ½", though other materials and dimensions would also work. The panels 14 are preferably oriented at an acute angle with respect to the plurality of sleepers 16. In FIG. 1, this angle is designated by reference numeral 20, and angle 20 is preferably about 45°. By orienting the panels 14 at an angle with respect to the prefabricated sleepers 16, the overall stability of the floor system 10 is enhanced. More particularly, if the angle 20 is 45° and the rows of prefabricated sleeper 16 are located on 17" centers, i.e. spaced 17 inches apart, the four corners of each of the panels 14 are supported directly on a sleeper 16.

Figure 4:
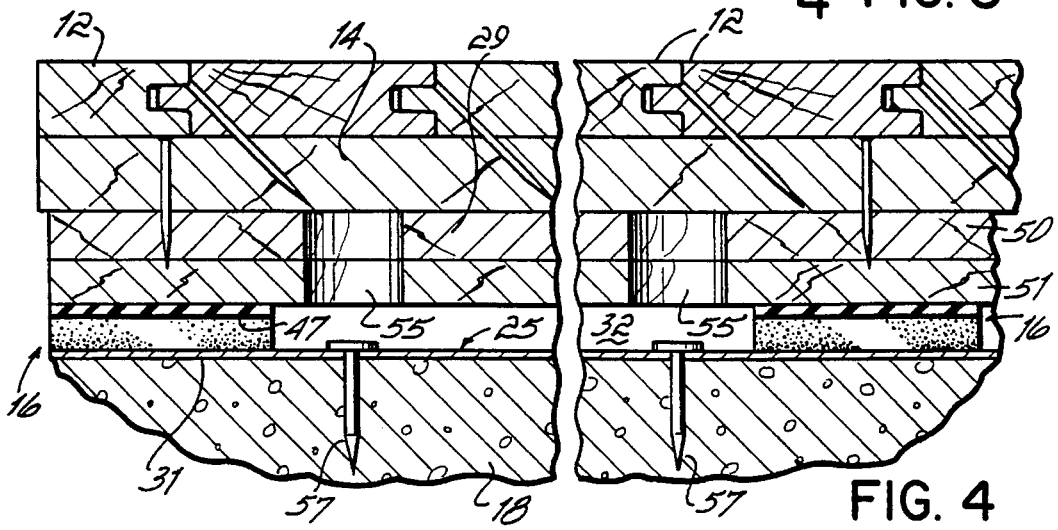
FIG. 4 is a longitudinal cross-sectional view taken along lines 4—4 of FIG. 3.
Figure 5:
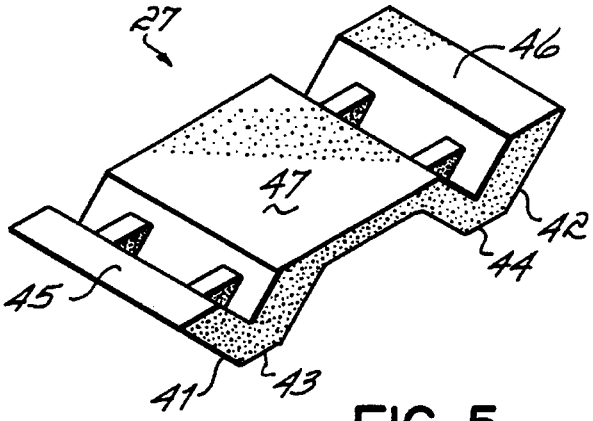
FIG. 5 is a perspective view of one embodiment of a pad used in a prefabricated sleeper according to this invention.
Figure 6:
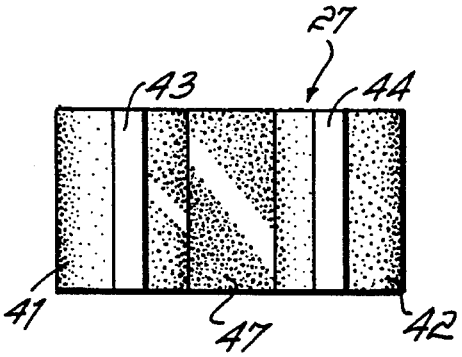
FIG. 6 is a bottom elevational view of the pad shown in FIG. 5.
Figure 7:
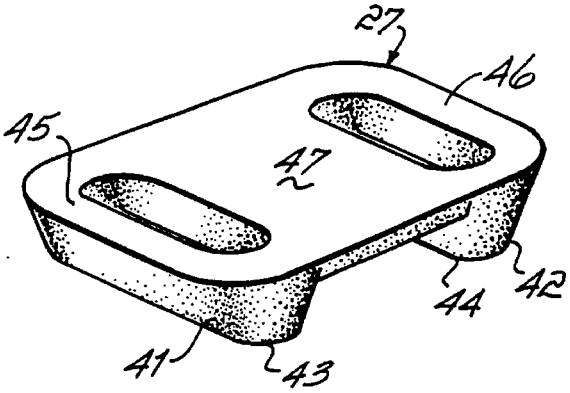
FIG. 7 is a perspective view of another embodiment of a pad used in a prefabricated sleeper according to this invention.
Figure 8:
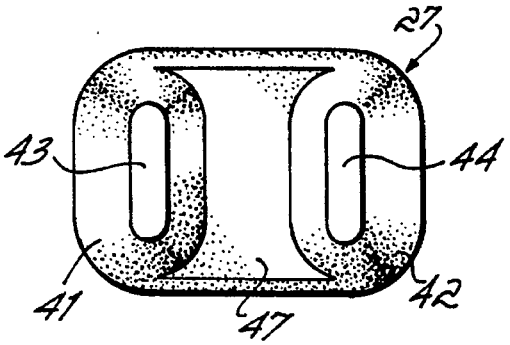
FIG. 8 is a bottom elevational view of the pad shown in FIG. 7.

During installation, the prefabricated sleepers 16 are laid end to end in parallel rows and then secured directly to the base 18. In some instances it may be necessary to place shims between the base 18 and the sleepers 16. For additional stability, each row of sleepers 16 is staggered with respect to the adjacent rows. The panels 14 are marked with chalk or any other suitable substance to indicate the locations of the sleepers 16. FIG. 1 shows markings indicated by reference numeral 22. The panels 14 are then secured to the sleepers 16 at the markings 22, preferably by staples (shown in FIG. 4) located about every six inches. The floorboards 12 are then secured to panels 14.

As indicated previously, the prefabricated sleeper 16 of this invention is somewhat similar to the sleeper disclosed in U.S. Pat. No. 4,856,250, which is expressly incorporated by reference herein in its entirety. Like the sleeper disclosed in this patent, the sleeper 16 of this invention provides anchored and resilient support for the floor system 10. Additionally, and more importantly, the sleeper 16 of this invention is prefabricated for immediate installation at the job site, thereby reducing shipping, time and labor costs associated with installing an anchored, resilient hardwood floor system.

Figure 2:
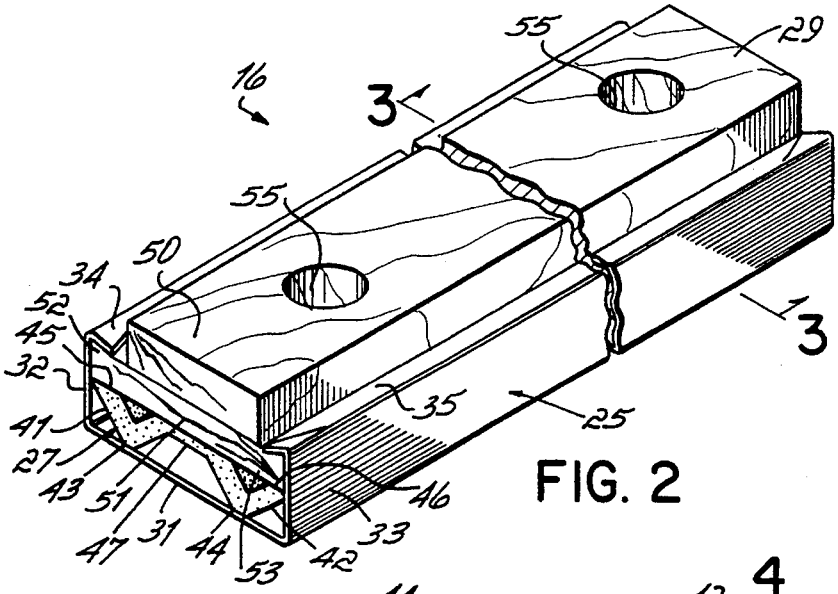
FIG. 2 is a perspective view of a prefabricated sleeper in accordance with a preferred embodiment of the invention.
Figure 3:
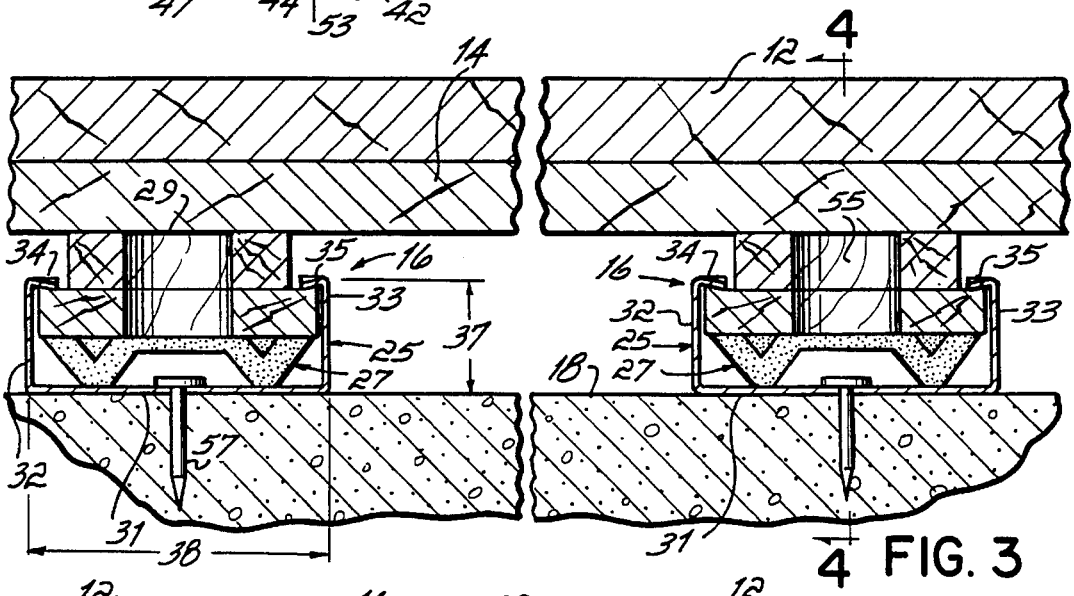
FIG. 3 is a transverse cross-sectional view of the prefabricated sleeper shown in FIG. 2 after being installed, with the other components of a floor system according to the invention.

FIG. 2 shows a preferred construction of the prefabricated sleeper 16. The prefabricated sleeper 16 includes an elongated channel 25, a plurality of pads 27 located in the channel and an elongated nailing strip 29 supported on the pads 27 within the channel 25. The nailing strip 29 has an inverted T-shape in cross section. The channel 25 is preferably 20-gauge steel and is about 8' long. The channel includes a bottom 31 and a pair of spaced, parallel sides, 32 and 33. Upper ends of the sides, 32 and 33, terminate in inwardly extending flanges, 34 and 35, respectively. The flanges 34 and 35 partially enclose the top of the channel 25 and define, in cross section, a "C-shape". The vertical dimension of sides 32 and 33 is designated by reference numeral 37 (FIG. 3) and is preferably about 1". The horizontal dimension of the bottom 31 is designated by reference numeral 38 and is preferably about 2 ⅝ " wide.

Each prefabricated sleeper 16 includes eight or nine pads 27 located along its length. The pads 27 are preferably of EDP rubber, have a durometer in the range of about 40 to 80 on the Shore A scale and have a height of about 5/16". FIGS. 5, 6, 7 and 8 show two preferred embodiments of the pad 27 used in this prefabricated sleeper 16. These pads 27 are disclosed in applicant's co-pending U.S. patent application Ser. No. 07/844,466, filed on Mar. 2, 1992 and entitled "KERFED HARDWOOD FLOOR SYSTEM". This application is expressly incorporated herein by reference in its entirety.

Each of these pads 27 includes a pair of spaced and parallel trapezoidal sections 41 and 42. Each of the trapezoidal sections 41 and 42 includes a flattened first end, 43 and 44, respectively and a hollow portion located adjacent a second end, 45 and 46, respectively. A flattened midsection 47 interconnects the two trapezoidal sections 41 and 42. For each pad 27, the total volume of the two hollow portions is less than the volume of the rest of the pad material. Moreover, the pad 27 decreases in transverse, cross sectional area from the first ends, 43 and 44 to the second ends, 45 and 46, respectively. There is no continuous line of material from the first ends 43 and 44 to the second ends 45 and 46, respectively.

In use, the first ends 43 and 44 contact the bottom 31 of the channel 25, and the second end 45 and 46 contacts the nailing strip 29. Preferably, each of the pads 27 is secured to the nailing strip 29 by a staple (not shown) driven through midsection 47 and into the enlarged bottom end of the nailing strip 29.

The elongated nailing strips 29 are equal in length to the channels 25, and the nailing strips 29 are preferably made of plywood or pine, or possibly a composite of wood and/or plastic. In cross-section, each nailing strip 29 has an inverted T shape. An upper reduced portion 50 extends above and between flanges 34 and 35. A lower enlarged portion 51 with two shoulders 52 and 53 is located therebelow, with shoulders 52 and 53 located below flanges 34 and 35, respectively. The overall thickness of the nailing strip 29 is about 1", and the thickness of the nailing strip 29 at the shoulders 52 and 53 is preferably about ⅝". Thus, beneath the flanges 34 and 35, the combined vertical dimension of the pad 27 and the respective shoulder, 52 or 53, is just less than, or equal to, one inch.

Each nailing strip 29 includes a plurality of vertical access holes 55 which extend therethrough. Preferably, for an 8' prefabricated sleeper 16, the nailing strip 29 has five access holes 55. Two of the access holes are located at the ends of the nailing strip 29, and the other three access holes 55 are spaced equidistantly along the nailing strip 29, about every 22.5" or 23". Preferably, there are eight total pads 27, with two pads 27 at the extremities of the sleeper 16, outside of the outer access holes 55, and the other six pads 27 located about every 13.71" along the sleeper 16. Preferably, the access holes 55 are about 1" in diameter. The access holes 55 provide direct mounting access to the bottom 31 of channel 25 for driving mechanical fasteners 57 therethrough and into the base 18.

This direct access to the bottom 31 of the channel 25 enables the prefabricated sleepers 16 to be laid end to end in final position at the job site and then secured to the base 18 in one step. There is no need to laterally offset the channels to enable horizontal sliding therein of a foam strip and a nailing strip, as required by U.S. Pat. No. 4,856,250. Thus, the access holes 55 in the prefabricated sleeper 16 significantly simplify installation and reduce labor costs associated with securing an anchored and resilient sleeper to a base.

The access holes 55 also enable the prefabricated sleepers 16 to be installed in a manner which does not prematurely compress the pads 27. Premature compression during installation may adversely effect the short-term and long-term benefits provided by resilient pads used in a sleeper.

In addition to providing anchoring, resiliency and positive securement of the floorboards 12 in spaced relation above the base 18, the prefabricated sleepers 16 of this invention may be easily installed in an accurate and consistent manner. To install the prefabricated sleeper 16, a pin fastening gun (not shown) may be extended through the one inch diameter access hole 55 so that its front end directly contacts the bottom 31 of the channel 25. Because of the relative dimensions of the inside diameter of the access hole 55 with respect to the outside diameter of the front end of the gun, the gun must be oriented at 90° in order to rest against the bottom 31. In this position, an installer shoots the gun to drive the fastener 57 through the bottom 31 and into the base 18 at the desired 90° angle.

Applicant has found that a modified, 32 caliber, single shot Hilti pin fastening gun, Model No. DX36M, has proved suitable for driving the fasteners 57 through the bottoms 31 of the channels 25 and into the base 18. Pins used with this gun are identified by Model No. DN 32 P8S15. This gun was modified by removing the detachable barrel extension from the end of the gun and machining the barrel extension to a uniformly circular outer diameter of 15/16". With this barrel extension of reduced outer diameter, the forward end of the gun fits within the one inch diameter of the access holes 55. The fasteners 57 are preferably 1¼" steel pins.

To manufacture a prefabricated sleeper 16 in accordance with this invention, an elongated wood strip is milled to the preferred T-shape to form the nailing strip 29. Five access holes 55 are then drilled through the nailing strip 29, two at the ends and three spaced about 22.5" apart along the mid-portion. Eight pads 27 are then stapled to the bottom, wider dimension of the nailing strip 29. Two pads 27 are located outside the outermost access holes 55, and the other six are spaced about every 13.71" along the nailing strip 29. This locates at least one pad 27 either next to, or relatively close to, each of the access holes. An elongated strip of 20 gauge steel is located adjacent the secured pads 27 and rolled upwardly around the pads 27 and around the shoulders 52 and 53 of the nailing strip 29. The edges of the steel strip are then bent or rolled inwardly to form the flanges 34 and 35 which define the partially enclosed C-shape, with the upper portion 50 of the nailing strip 29 extending thereabove.

Alternatively, a casing member other than an elongated steel strip may be used to form the channel 25. For instance, a synthetic material may be extruded into the desired shape while feeding the nailing strip 29 and pads 27 through the center of the extruding die, thereby forming a channel with the casing member around the partially enclosed nailing strip 29 and pads 27 attached thereto.

To install the floor system 10 of this invention, the prefabricated sleepers 16 are shipped to the job site, where they are laid end to end in staggered parallel rows. Although the spacing of the rows of prefabricated sleepers 16 may vary, applicant has found that a 16" or 17" spacing is preferable. A 17" spacing enables the layer of panels 14 to be angled at about 45° so that the corners are supported. With the prefabricated sleeper 16 in place, the tops of the panels 14 are marked with chalk to form markings 22 which indicate the locations of the rows of prefabricated sleepers 16 therebelow. The panels 14 are then secured to the sleepers 16 by staples (shown in FIG. 4) located about every six inches along the markings 22. The floorboards 12 are then secured to the panels 14.

While a preferred embodiment of the invention has been described, applicant does not wish to be limited thereby, and it is to be understood that various modifications could be made without departing from the spirit of the invention. Accordingly, it is to be understood that changes may be made without departing from the scope of the invention as particularly set out and claimed.

I claim:

1. A method of constructing a sleeper comprising the steps of:

milling an elongated strip to a predetermined shape with an enlarged dimension at a first end and a reduced dimension at a second end;

drilling at least one access hole through the strip from the first end to the second end;

securing at least one pad to the first end of the strip at a location removed laterally from the access hole; and locating a casing member adjacent to the secured pad and forming the member around the pad and the strip toward the second end, thereby to form a prefabricated sleeper with a channel which partially encloses the strip and the pads, but leaves the second end of the strip protruding outwardly therefrom.

2. The method of claim 1 wherein said casing member is an elongated sheet and opposed ends of the sheet are rolled around the nailing strip and the pads.

3. The method of claim 1 wherein said casing member is an extrudate.

4. A method of installing a hardwood floor system comprising the steps of:

providing a prefabricated sleeper, the sleeper including a channel, a plurality of pads located in the channel and a nailing strip supported on the pads in the channel, the nailing strip having at least one vertical access hole therethrough to provide access to the bottom of the channel; and extending a fastener through the access hole and driving the fastener through the bottom of the channel and into the base, thereby to secure the sleeper to the base.

5. The method of claim 4 wherein the extending step further comprises:

locating a front end of a fastener gun within the access hole and in direct contact with the bottom of the channel; and shooting a fastener from the gun, through the bottom of the channel and into the base.

6. The method of claim 4 and further comprising the steps of:

securing a plurality of said prefabricated sleepers to the base;

locating at least one layer of panels on the sleepers;

marking the top surfaces of the panels to indicate the locations of the sleepers;

securing the panels to the sleepers at said markings; and securing a top layer having a wear surface to an uppermost layer of said at least one layer of panels.

7. The method of claim 2 wherein said at least one layer of panels is oriented at an acute angle with respect to the sleepers.

8. The method of claim 3 wherein the panels are angled such that the corners of the angled panels are supported on sleepers.

* * * * *